US007604048B2

(12) United States Patent
Kossa et al.

(10) Patent No.: US 7,604,048 B2
(45) Date of Patent: Oct. 20, 2009

(54) SPRING ENERGIZED DEBRIS BARRIER FOR MECHANICALLY SET RETRIEVABLE PACKER

(75) Inventors: Edward J. Kossa, Huffman, TX (US); Rafael Ramirez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 223 days.

(21) Appl. No.: 11/602,686

(22) Filed: Nov. 21, 2006

(65) Prior Publication Data

US 2008/0115929 A1 May 22, 2008

(51) Int. Cl.
*E21B 23/06* (2006.01)

(52) U.S. Cl. ..... 166/179; 166/119; 166/191

(58) Field of Classification Search ..... 166/179, 166/119, 191

See application file for complete search history.

(56) References Cited

U.S. PATENT DOCUMENTS 3,516,493 A 6/1970 McGill
5,146,993 A 9/1992 Gambertoglio
6,112,811 A 9/2000 Kilgore et al.
6,119,774 A * 9/2000 Doane et al. ..... 166/134
6,302,217 B1 10/2001 Kilgore et al.
6,536,532 B2 * 3/2003 Doane ..... 166/387
6,715,560 B2 * 4/2004 Doane et al. ..... 166/387
2002/0121380 A1 9/2002 Doane et al.

OTHER PUBLICATIONS

King, James G., et al., "A Methodology for Selecting Interventionless Packer Setting Techniques", SPE 90678, Sep. 2004, 1-11.

* cited by examiner

*Primary Examiner*—William P Neuder
*Assistant Examiner*—Nicole A Coy
(74) *Attorney, Agent, or Firm*—Steve Rosenblatt

(57) ABSTRACT

A debris barrier for a retrievable mechanical set packer is held retracted for run in. It is held spaced apart from upper slips and uses a spring bias that acts on the slips to keep them energized to also energize the barrier to the extended position to keep debris out of the upper slips when the packer is set. The debris barrier is preferably a sleeve that is axially compressed by the setting procedure to increase in diameter and span the gap between the packer mandrel and the set upper slips. Retrieving the packer is enabled by a retraction of the debris barrier as the upper slips are undermined with rotation and pickup force on the packer mandrel. The lack of a debris barrier could prevent retrieval of the packer in well bores where debris is present and has a tendency to settle around and more critically under the upper slips.

20 Claims, 2 Drawing Sheets

SPRING ENERGIZED DEBRIS BARRIER FOR MECHANICALLY SET RETRIEVABLE PACKER

FIELD OF THE INVENTION

The field of the invention is debris barriers for retrievable downhole tools and more particularly for mechanically set packers.

BACKGROUND OF THE INVENTION

Packers are used downhole to isolate different zones. Some packers are made to be removed at a later time after being set in the well for what could be fairly long time periods. These packers are referred to as retrievable. They generally feature slips actuated by cones that are moved under the slips to move them out radially to support the packer. A sealing element assembly is between the upper and lower slips. In order to retrieve such packers the cone that wedges in a slip assembly has to be retracted from under the slip that it formerly wedged against a tubular. Usually, on mechanical set packers the mandrel is manipulated by tubing string rotation so that it pulls the cone out from under the upper slip assembly to allow the sealing element to relax as the packer extends so that it can then be pulled out.

Retrievable packers can be pressure set with applied pressure moving a piston that brings the cones of the slips together to move them out while compressing the sealing element. Mechanically set packers usually have drag blocks, which are spring energized members to give temporary support to the packer outer housing as a tubing string connected to the mandrel is manipulated by rotation. One style uses a j-slot so that the tubing can be turned and set down and the string weight applied to the mandrel sets the packer as the outer housing is supported on the drag blocks.

Pressure set retrievable packers, in the past, have recognized the need for a debris barrier above the upper slips. The solution offered in U.S. Pat. Nos. 6,302,217 and 6,112,811 involves a rubber ring on a slip ramp so that when a pressurized piston gets the packer parts moving, the upper slip riding on its respective ramp pushes out a rubber ring and wedges it into a gap against the surrounding tubular after it crests the slip ramp. In a variation, the debris barrier is initially held in a groove above and below a slip assembly and setting the slips with a pressurized piston forces the debris barrier ring out of its run in groove and up the slip ramp where it hopefully becomes wedged against the surrounding tubular.

While the design appears to address the problem on paper, it has many practical limitations. Directly forcing a ring to enlarge in diameter and move up an inclined ramp several issues are encountered. The ring as it enlarges in diameter can roll about its circumferential center line. If this happens it will move up the ramp unevenly leaving less than 360 protection and is also likely to rip before becoming wedged against the surrounding tubular. Another concern from this type of wedging action is that the debris barrier can be subjected to a wedging force that can be sufficient to extrude it, which can also result in a tear. If the ring is dependent of slip movement to ramp it out, any failure along the ramp can result in pieces of the ring acting as a brake on movement of the slip assembly up the ramp. As a result, a less than optimal grip is obtained and the set packer is exposed to the possibility of loss of grip.

While debris barriers have been offered in pressure set packers that rely on driving a setting piston to actuate the slips and sealing element, such barriers have not been available on mechanical set packers that are also designed to be retrievable. The present invention addresses this need in such packers with a design that can be simply retrofit on existing mechanical set retrievable packers. The design spaces the debris barrier from the slip assembly and keeps it energized while the packer is set. The barrier is retracted for run in and can be readily extended to bridge the gap to the surrounding tubular when the packer is set. These and other features of the present invention will be more readily apparent to those skilled in the art from a review of the description of the preferred embodiment and the associated drawings, recognizing that the full scope of the invention is indicated in the attached claims.

SUMMARY OF THE INVENTION

A debris barrier for a retrievable mechanical set packer is held retracted for run in. It is held spaced apart from upper slips and uses a spring bias that acts on the slips to keep them energized to also energize the barrier to the extended position to keep debris out of the upper slips when the packer is set. The debris barrier is preferably a sleeve that is axially compressed by the setting procedure to increase in diameter and span the gap between the packer mandrel and the set upper slips. Retrieving the packer is enabled by a retraction of the debris barrier as the upper slips are undermined with rotation and pickup force on the packer mandrel. The lack of a debris barrier could prevent retrieval of the packer in well bores where debris is present and has a tendency to settle around and more critically under the upper slips.

DETAILED DESCRIPTION OF THE PREFERRED EMBODIMENT

Figure 3:
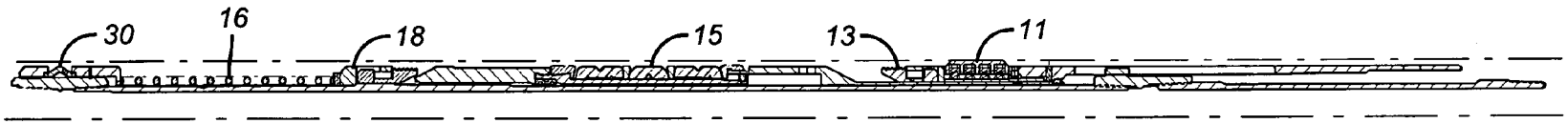
FIG. 3 is a layout of an entire packer with the debris barrier shown in the run in position.
Figure 4:
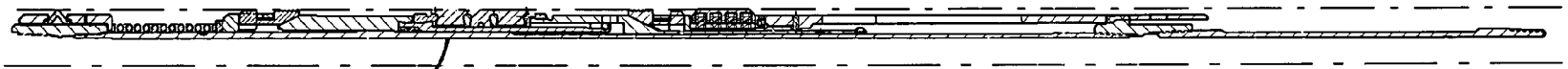
FIG. 4 is the view of FIG. 3 in the set position.
Figure 5:
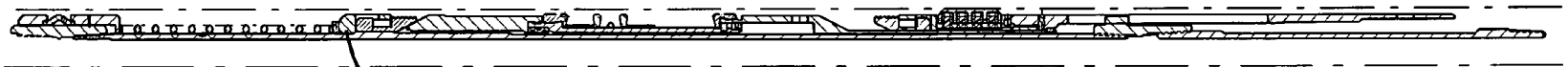
FIG. 5 is the view of FIG. 4 in the released position.

Those skilled in the art of mechanical set packers are presumed to be familiar with its major components and such components are depicted in the FIGS. 3-5. Typically, such packers have an outer housing that is temporarily supported in the wellbore by drag blocks 11, which are spring loaded dogs that catch on the surrounding tubular and provide temporary support for a mandrel 10 that is connected to a top sub 12 and supported by a tubing string (not shown) that is connected at thread 14 and continues up the well bore to surface. Typically, there is some type of j-slot mechanism between the outer housing and the mandrel 10 that lets the mandrel 10 be manipulated relative to the outer housing that is supported by the drag blocks. This mandrel manipulation occurs from surface by rotation of the tubing string.

Figure 2:
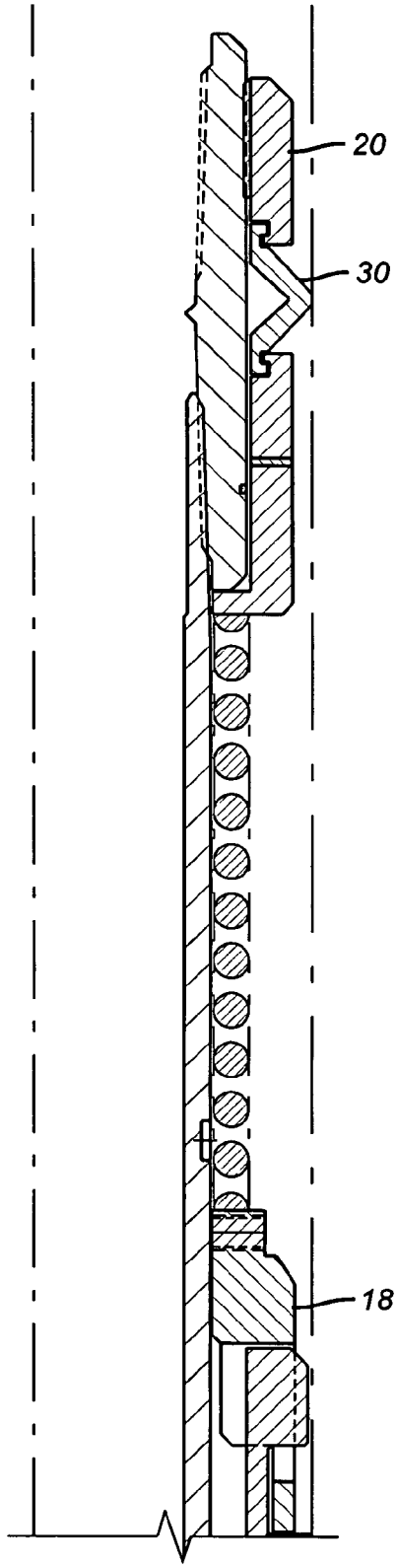
FIG. 2 shows the debris barrier in the set position.

In prior designs the spring 16 would bear on the top sub 12 on one end and on a slip assembly 18 shown in FIG. 2. The rotational manipulation of the mandrel 10 would bring the top sub 12 closer to the stationary drag blocks so as to compress spring 16 against the upper slip assembly 18 and in the process also set lower slips 13 and a sealing element 15 that are below upper slip assembly 18. While there were variations, the components above and the manner of setting the mechanical set packers of the past fairly closely tracked the procedure described above. Finally, the setting down weight on the mandrel 10 allowed the slips to hold a compressed sealing element pushed out against a surrounding tubular with spring 16 being compressed against the top sub 12. In the course of this setting motion the mandrel 10 would automatically track into a set position in the J slot causing the packer to remain set when compression is removed. Release involved the rotation of the mandrel 10 and picking up the top sub 12 to allow spring 16 to go slack and the grabbing of the slip assembly 18 for an upward pull to get a slip ramp out from under the upper slips so that the packer sealing element and the lower slips could extend and the packer could be removed.

Figure 1:
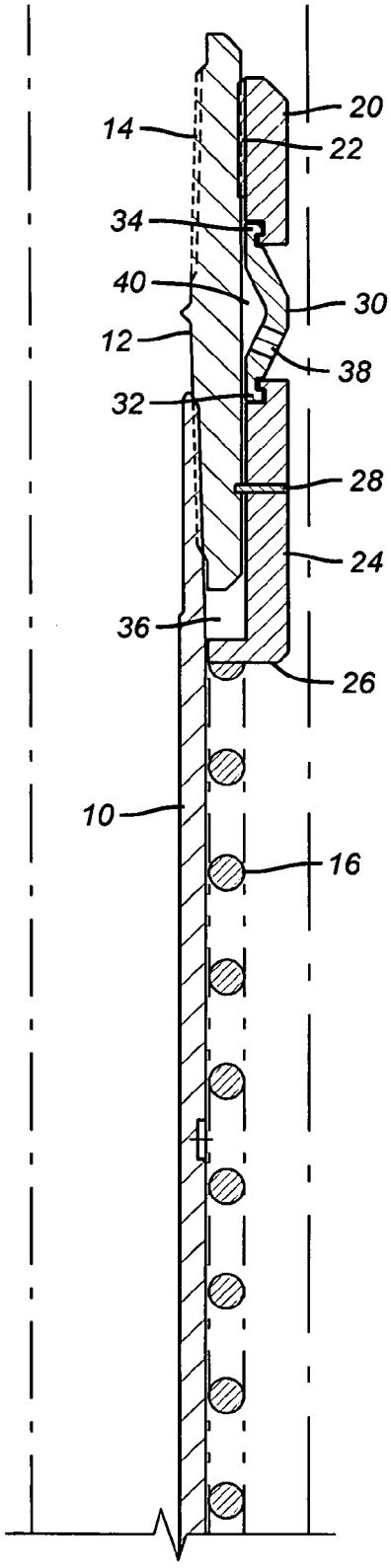
FIG. 1 shows the debris barrier in the run in position.

The present invention modifies the existing mechanical set packer design by adding a ring 20 secured to top sub 12 at thread 22. A lower ring 24 has a bottom shoulder 26 on which spring 16 bears. For run in, the position of lower ring 24 is retained with respect to top sub 12 with a shear pin 28. The debris barrier 30 is preferably a sleeve that has captured ends 32 and 34 respectively by rings 20 and 24. Setting down weight on top sub 12 closes gap 36 as the shear pin 28 breaks. When that happens, the spring 16 that becomes more compressed as the setting of the packer proceeds pushes ring 24 uphole as ring 20 is moved downhole due to the setting down weight. The debris barrier 30 simply collapses as its ends 32 and 34 are brought toward each other and are biased toward each other by the action of spring 16. As shown in FIG. 1, the barrier 30 can have one or more folds akin to a bellows to reduce its resistance to collapse and to guide its radial movement to bridge the gap to the surrounding tubular so that it may act as a debris barrier. Openings 38 can be provided in the barrier 30 to prevent it from liquid locking should an annular volume 40 fill with incompressible fluid. This also prevents the debris barrier from forming any type of annular seal. Ideally, volume 40 will have air at atmospheric pressure when the packer is run in however it may also be pre-charged with a compressible fluid under pressure and held in the retracted position of FIG. 1 by shear pin 28 without departing from the invention. Those skilled in the art will appreciate that existing mechanical set retrievable packers can be simply retrofitted with a debris barrier with minimal modification making them easier to release when it comes time to pull the support out from under an upper slip assembly. The debris barrier is spaced from the slip assembly and preferably uses a bellows action to expand radially although other shapes are contemplated. The barrier remains under a bias force with the packer set. The barrier can alternatively be a solid ring made of a resilient material or it can be a layered assembly that is solid or has internal voids. The spring 16 encompasses many types of mechanical springs as well as alternative and equivalent structures that rely on compressing a compressible gas or application of pressurized fluid to selectively keep the debris barrier in the extended position.

The above description is illustrative of the preferred embodiment and various alternatives and is not intended to embody the broadest scope of the invention, which is determined from the claims appended below, and properly given their full scope literally and equivalently.

We claim:

1. A packer for downhole use, comprising:

a mandrel supporting a sealing element and at least one slip;

an outer housing around said mandrel further comprising a support to engage downhole prior to radial extension of said sealing element and said slip, said sealing element and slip extending radially upon relative movement between said mandrel and said outer housing with said outer housing being supported from its support;

a debris barrier spaced above said slip and said sealing element, having opposed ends supported by said mandrel and actuated by said relative movement bringing said opposed ends toward each other.

2. The packer of claim 1, wherein:

said debris barrier is biased by a biasing member when in a radially extended position.

3. The packer of claim 2, wherein:

said debris barrier is selectively retained in a retracted position;

said debris barrier is selectively released by a push force delivered to an intact mandrel.

4. The packer of claim 3, wherein:

said debris barrier comprises a flexible sleeve.

5. The packer of claim 4, wherein:

said sleeve comprises at least one fold.

6. The packer of claim 5, wherein:

said ends of said sleeve are captured by a first and second ring.

7. The packer of claim 6, wherein:

said first of said rings is initially retained to said mandrel with a member that breaks.

8. The packer of claim 7, wherein:

said bias on said sleeve acts on said first ring.

9. The packer of claim 8, wherein:

said bias on said sleeve acts on said slip.

10. The packer of claim 9, wherein:

said relative movement between said outer housing and said mandrel breaks said member that initially retains said first ring to allow said first ring to be biased toward a second ring.

11. The packer of claim 10, wherein:

movement of said first ring toward said second ring collapses said sleeve along said fold.

12. The packer of claim 7, wherein:

said member that breaks comprises at least one shear pin.

13. The packer of claim 5, wherein:

said sleeve comprises a wall opening.

14. The packer of claim 13, wherein:

said opening is positioned between said fold and said slip.

15. The packer of claim 5, wherein:

said sleeve defines a volume about said mandrel, said volume containing a compressible fluid.

16. The packer of claim 15, wherein:

said compressible fluid is trapped in said volume at substantially atmospheric pressure.

17. The packer of claim 15, wherein:

said compressible fluid is trapped in said volume at a pressure high enough to urge said sleeve radially out in the wellbore.

18. The packer of claim 2, wherein:

said bias is in the axial direction and caused by at least one spring.

19. The packer of claim 1, wherein:

said debris barrier comprises a ring that initially abuts said mandrel and is axially compressed to extend radially by said relative movement.

20. The packer of claim 1, wherein:

said debris barrier is spaced apart from said slip.

* * * * *